US010300508B2

(12) United States Patent
Eberts et al.

(10) Patent No.: US 10,300,508 B2
(45) Date of Patent: May 28, 2019

(54) TROMMEL SCREEN WITH DIFFERENT SIZED APERTURES

(71) Applicant: Vermeer Manufacturing Company, Pella, IA (US)

(72) Inventors: Kenneth Scott Eberts, Freeman, SD (US); Jason Luke, Freeman, SD (US); Nathan Lee Torberson, Freeman, SD (US); Curtis A. Strand, Mitchell, SD (US); Jeremy W. Handel, Menno, SD (US); Erin C. Lachman, Freeman, SD (US); Douglas L. Dubs, Freeman, SD (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 15/052,463

(22) Filed: Feb. 24, 2016

(65) Prior Publication Data

US 2016/0354806 A1 Dec. 8, 2016

Related U.S. Application Data

(60) Provisional application No. 62/120,272, filed on Feb. 24, 2015.

(51) Int. Cl.

| | |
|---|---|
| ***B07B 1/22*** | (2006.01) |
| ***B07B 1/00*** | (2006.01) |
| ***B07B 13/16*** | (2006.01) |

(52) U.S. Cl.

CPC ..... *B07B 1/22* (2013.01); *B07B 1/005* (2013.01); *B07B 13/16* (2013.01)

(58) Field of Classification Search

CPC ..... B07B 1/185; B07B 1/22; B07B 1/24

(Continued)

(56) References Cited

U.S. PATENT DOCUMENTS 513,973 A * 2/1894 Aulmann ..... B07B 1/22 209/291
772,331 A * 10/1904 Baxter ..... B07B 1/22 209/289

(Continued)

OTHER PUBLICATIONS

Equipment News, "Third Product Split on Trommel," Biocyle, Oct. 2014, vol. 55, No. 9, p. 56 (2 pgs).

(Continued)

*Primary Examiner* — Joseph C Rodriguez
(74) *Attorney, Agent, or Firm* — Merchant & Gould P.C.

(57) ABSTRACT

A screening machine includes a rotary trommel screen having an overall length. The rotary trommel screen has an inlet and an outlet end. The screening machine includes a first collection area proximate to the inlet end and under the rotary trommel screen. The first collection area corresponds to at least 65 percent of the overall length of the trommel screen. The screening machine includes a second collection area proximate to the outlet end and under the rotary trommel screen. The second collection area corresponds to the remainder of the overall length of the trommel screen not corresponding to the first collection area. The first and second collection areas are configured to separate a first and second product respectively. Sections of the trommel screen corresponding to the first and second collection areas are configured such that a size of the first product is different than a size of the second product.

28 Claims, 3 Drawing Sheets

(58) Field of Classification Search
USPC ..... 209/284, 288, 289, 290
See application file for complete search history.

(56) References Cited

U.S. PATENT DOCUMENTS

| | | | | | |
|---|---|---|---|---|---|
| 882,955 | A * | 3/1908 | Neufeld | B07B 13/02 | 209/687 |
| 1,161,487 | A * | 11/1915 | Little | B07B 1/10 | 209/290 |
| 1,185,770 | A * | 6/1916 | Cody | B07B 1/22 | 209/393 |
| 1,301,277 | A * | 4/1919 | Kronenberg | B07B 4/02 | 209/234 |
| 1,845,441 | A * | 2/1932 | Robertson | B07B 4/06 | 209/137 |
| 2,543,898 | A * | 3/1951 | De Vaney | B03D 1/08 | 209/288 |
| 3,036,706 | A * | 5/1962 | Taudiere | B07B 9/02 | 209/137 |
| 4,585,354 | A * | 4/1986 | Thesenfitz | E01C 19/05 | 209/238 |
| 4,915,826 | A * | 4/1990 | Nordhus | B07B 1/24 | 209/247 |
| 5,019,248 | A * | 5/1991 | Kaldor | D21B 1/025 | 209/240 |
| 5,021,150 | A * | 6/1991 | Burklin | B07B 1/22 | 209/245 |
| 5,091,077 | A * | 2/1992 | Williams | B03B 9/06 | 209/135 |
| 5,348,162 | A * | 9/1994 | Wroblewski | B03B 9/06 | 198/669 |
| 5,429,248 | A * | 7/1995 | Le Gigan | B07B 1/24 | 209/239 |
| 5,507,396 | A * | 4/1996 | Hauch | B07B 1/18 | 209/290 |
| 5,752,435 | A * | 5/1998 | Wai | A23N 15/02 | 15/3.16 |
| 6,360,876 | B1 * | 3/2002 | Nohl | B65G 69/10 | 198/302 |
| 6,360,894 | B1 * | 3/2002 | Devlin | B07B 1/22 | 209/291 |
| 7,080,742 | B2 * | 7/2006 | Arvidson | B07B 13/02 | 209/2 |
| 7,273,150 | B2 | 9/2007 | Fridman et al. | | |
| 7,497,337 | B2 * | 3/2009 | Tse | B02C 17/007 | 209/284 |
| 8,505,738 | B2 * | 8/2013 | O'Keeffe | B07B 1/005 | 209/240 |
| 2004/0140381 | A1 * | 7/2004 | Rose | B07B 1/22 | 241/79.3 |
| 2007/0221545 | A1 * | 9/2007 | Liu | B03B 9/06 | 209/289 |
| 2016/0303609 | A1 * | 10/2016 | Rudas | B07B 1/22 | |

OTHER PUBLICATIONS

Trade2CN.com, "Mining waste trommel screen," last updated Oct. 8, 2013 (2 pgs).
Wikimedia Commons, "Trommel screen.jpg," Apr. 25, 2008 (2 pgs).
PP&E, "Screen splits second product into third marketable size," May 14, 2014 (1 pg).
Henan Pingyuan Mining Manufacturing Co., Ltd., "Trommel Screen," Jul. 15, 2015 (5 pgs).
Wikipedia, "Trommel screen," Oct. 15, 2013 (12 pgs).

* cited by examiner

TROMMEL SCREEN WITH DIFFERENT SIZED APERTURES

CROSS REFERENCE TO RELATED APPLICATION

The present patent application claims the benefit of U.S. Provisional Patent Application Ser. No. 62/120,272, filed Feb. 24, 2015, which patent application is hereby incorporated by reference in its entirety.

BACKGROUND

Screening machines are used to process unconsolidated material that contains a variety of differently sizes particulates into separate consolidated material comprising separate grades. In some instances, rotary screening trommels that use a substantially cylindrical shaped screening apparatus are used. These rotary screening trommels include a feed end for receiving material and a discharge end for discharging material. Rotary screening trommels operate by receiving unconsolidated material at the inlet, rotating as the material travels length-wise through the cylindrical shaped screening apparatus, and separating smaller material from larger material by allowing the smaller material to fall through the screening trommel during rotation. Larger material is then discharged from the discharge end of the screening trommel. Conveyors are used to move the separated consolidated material away from the screening machine and into separate piles. Additionally, hoppers are also used to collect the separated material.

SUMMARY

The present disclosure relates generally to a screening machine. In one possible configuration, and by non-limiting example, the screening machine includes a rotary trommel screen configured to process two or three separate grades of material.

In a first aspect of the present disclosure, a screening machine is disclosed. The screening machine includes a rotary trommel screen having an overall length. The rotary trommel screen has an inlet and an outlet end. The screening machine includes a first collection area proximate to the inlet end and under the rotary trommel screen. The first collection area corresponds to at least 65 percent of the overall length of the trommel screen. The screening machine includes a second collection area proximate to the outlet end and under the rotary trommel screen. The second collection area corresponds to the remainder of the overall length of the trommel screen not corresponding to the first collection area. The first and second collection areas are configured to separate a first and second product respectively. Sections of the trommel screen corresponding to the first and second collection areas are configured such that a size of the first product is different than a size of the second product.

In a second aspect of the present disclosure, a screening machine is disclosed. The screening machine includes a rotary trommel screen that has an overall length. The rotary trommel screen further has an inlet end and an outlet end. The screening machine also includes a first collection area proximate to the inlet end and under the rotary trommel screen. The screening machine also includes a second collection area proximate to the outlet end and under the rotary trommel screen. The first and second collection areas are configured to separate a first and second product respectively. Sections of the trommel screen corresponding to the first and second collection areas are configured such that a size of the first product is different than a size of the second product. The screening machine also includes a first conveyor positioned longitudinally with the trommel screen. The first conveyor is selectively reversible and configured to move in a direction toward the inlet end of the trommel screen or in a direction toward the outlet end of the trommel screen.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
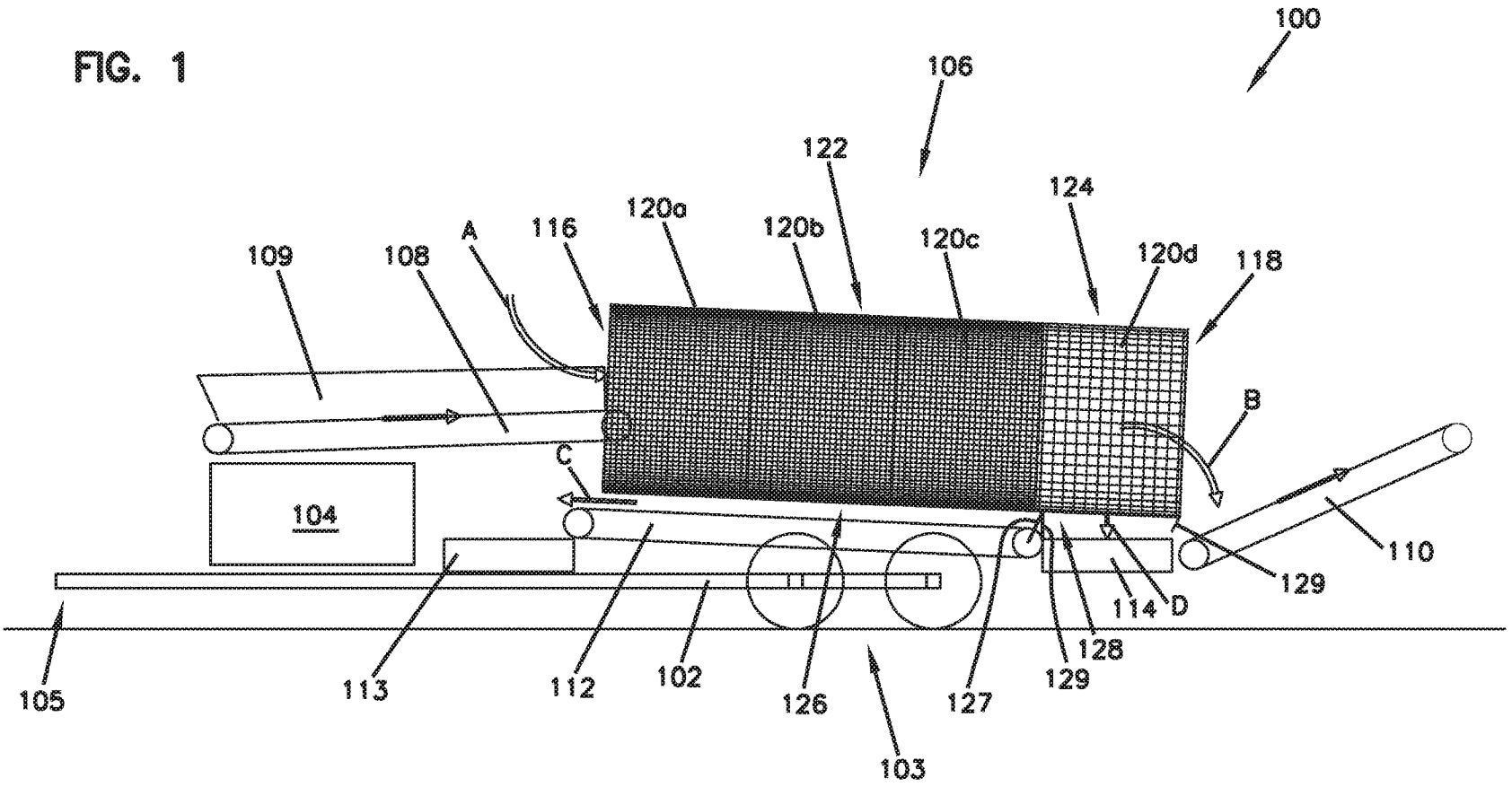
FIG. 1 illustrates a schematic side view of a screening machine, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The portable screening machine of the present disclosure includes a single rotary trommel screen with a plurality of screening sections. The screening machine is configured to separate an unconsolidated material into two or three separate consolidated products, each separated product having a separate grade.

FIG. 1 depicts screening machine 100. The screening machine 100 includes a trailer support 102, a power system 104, a rotary trommel screen 106, an inlet conveyor 108, an outlet conveyor 110, a collecting conveyor 112, a front fines conveyor 113, and a rear fines conveyor 114. The screening machine 100 is configured to separate an unconsolidated material into three separate consolidated products (a first product, a second product, and a third product), delivered via the outlet conveyor 110, the front fines conveyor 113, and the rear fines conveyor 114.

The trailer support 102 of the screening machine 100 is configured to support the screening machine 100 during transport and operation. The trailer support 102 includes a plurality of wheels and axles 103, the specific number being dependent on the overall size and weight of the screening machine 100. The trailer support 102 also includes a hitching end 105 configured to be attached to a towing vehicle. In some embodiments, the trailer support 102 includes stabilizing elements (not shown) configured to stabilize the screening machine 100 during stationary operation. Also, in some embodiments, the trailer support 102 is configured to be transported on public roadways by a towing vehicle.

The power system 104 provides power to the screening machine 100 during operation. The power system 104 includes an engine. In some embodiments, the engine is a diesel engine. In addition, the power system 104 includes a hydraulic system. In some embodiments, the power system 104 can be mounted to a pivotable frame to allow for ease of access during maintenance. In some embodiments, the power system 104 and the screening machine 100, in their entirety, are operable remotely or by a control panel that is in communication with the power system 104.

The rotary trommel screen 106 is configured to receive and filter unconsolidated material. The rotary trommel screen 106 includes an inlet 116, an outlet 118, a plurality of removable screen portions 120, a first screen section 122, and a second screen section 124. In some embodiments, the rotary trommel screen 106 is generally cylindrical in shape. Additionally, the diameter of the rotary trommel screen 106 is about two meters, in some embodiments. The rotary trommel screen 106 has an overall length measured from the inlet 116 to the outlet 118. In general, the rotary trommel screen 106 is configured to separate smaller material, proximate to the inlet, 116 from larger material, which is removed proximate to, or from, the outlet 118. During operation, the rotary trommel screen 106 rotates about a longitudinal axis, which causes material contained with the rotary trommel screen 106 to be stirred. In some embodiments, the rotary trommel screen 106 can include longitudinally mounted lifting bars (not shown) that are mounted to the inside of the rotary trommel screen 106. Additionally, in some embodiments, the rotary trommel screen 106 is mounted so that the rotary trommel screen 106 slopes downward from the inlet 116 to the outlet 118. Such a slope encourages material to travel from the inlet 116 to the outlet 118 during operation.

The inlet 116 of the rotary trommel screen 106 is configured to receive (shown as arrow A) an unconsolidated material. In some embodiments, the unconsolidated material may be fed to the inlet 116 of the rotary trommel screen 106 by the inlet conveyor 108. In other embodiments, material may be fed to the inlet 116 by way of a material hopper. Alternatively, the outlet 118 of rotary trommel screen 106 is configured to provide an opening for material that is not removed from the rotary trommel screen 106 by way of passing through the screen portions 120. Arrow B represents material being removed from the outlet 118

The removable screen portions 120 are configured to be removably attached to the rotary trommel screen 106. The screen portions 120 each include a plurality of screen apertures configured to allow the passage of material through the screen portions 120. During operation, material that is sized similarly to, or smaller than, the size of the screen apertures passes from inside the rotary trommel screen 106 to outside out the rotary trommel screen 106, through the screen portions 120. Screen portions 120 having screen apertures of different sizes can also be used, the size of which is dependent on the particular application and the size of material that is desired to be screened. In the depicted embodiment, the rotary trommel screen 106 includes four screen portions 120*a*, 120*b*, 120*c*, and 120*d*.

In the depicted embodiment, the first screen section 122 includes three similarly sized screen portions 120*a*, 120*b*, and 120*c*. In the depicted embodiment, the screen portions 120*a*, 120*b*, and 120*c* in the first screen section 122 include screen apertures that are substantially similar in size. The first screen section 122 is configured to separate a first product from material that is inserted at inlet 116. The first product passes through the first screen section 122 and into a first collection area 126. The first collection area 126 is the space below the first screen section 122. In some embodiments, the first collection area 126 deposits the first material into a holding container for the first product, known as a hopper. In other embodiments, the first collection area 126 deposits the first material into an external holding container for the first product. In the depicted embodiment, the first collection area 126 deposits the first material onto the collecting conveyor 112, which may be configured for delivering the first material to the front fines conveyor 113. In some embodiments, the first collection area 126 includes removable guides or funnels 127 that help to guide the first product into the first collection area 126.

In the depicted embodiment, the second screen section 124 includes a screen portion 120*d*. The screen portion 120*d* includes screen apertures that are differently sized than the screen apertures of the screen portions 120*a*, 120*b* and 120*c* of the first screen section 122. In some embodiments, the screen apertures of the screen portion 120*d* are larger than the screen apertures of screen portions 120*a*, 120*b*, and 120*c*. In some embodiments, the screen portion 120*d* is configured to filter a second product from material that is inserted at inlet 116 of the rotary trommel screen 106. In some embodiments, the second product is larger in size when compared to the first product. Similar to the first product, the second product passes through the second screen section 124 and into a second collection area 128, shown by arrow D. The second collection area 128 is the space below the second screen section 124. In some embodiments, the second collection area 128 deposits the second material into a hopper. In other embodiments, the second collection area 128 deposits the second material into an external holding container for the second product. In the depicted embodiment, the second collection area 128 deposits the second material onto the rear fines conveyor 114. In some embodiments, the second collection area 128 includes removable guides or funnels 129 that help to guide the second product into the second collection area.

In the depicted embodiment, the first collection area 126 corresponds to at least 75 percent of the overall length of the trommel screen 106, while the second collection area 128 corresponds to the remainder of the overall length of the trommel screen 106 not corresponding to the first collection area 126. In some embodiments, the overall effective screening length of the rotary trommel screen 106 is about 20 feet. In such an embodiment, the first collection area 126 occupies about the first 15 feet of the overall length, starting at the inlet 116, and the second collection area 128 occupies about the final 5 feet of the overall length, proximate to the outlet 118. In some embodiments, different numbers of screen portions 120 can be used. This can affect the size of the first and second collection areas 126, 128 and the size of the first and second screen sections 122, 124. In some embodiments, the first collection area 126 corresponds to at least 65 percent of the overall length of the trommel screen 106, while the second collection area 128 corresponds to the remainder of the overall length of the trommel screen 106 not corresponding to the first collection area 126.

This configuration of screen sections 122, 124 and first and second collection areas 126, 128 has proven to provide surprising results. When the screening machine 100 is operated to sort material into three product sizes, the distribution of the amount of material in each product size has been surprising. With the rotary trommel screen 106 configured to have a the first collection area 126 and corresponding first screen section 122 that corresponds to at least 65 percent of the overall length of the trommel screen 106, while the second collection area 128 and corresponding first screen section 124 corresponds to the remainder of the overall length of the trommel screen 106 not corresponding to the first collection area 126 the resulting material split has been surprising.

It has been found that while the material is in the first screen section 118 of the rotary trommel screen 106, where the smallest materials are being separated from the middle sized and over-sized materials, the separation efficiency is the lowest. By the time that the smallest materials (first product) have been sorted out through the first screen section 118, and the left-over material enters the second screen section 124, the middle-sized materials (second product) are sorted from the over-sized materials (third product) and the separation efficiency is higher. The net effect has been that even though the separation of the first product has at least 65 percent of the length of the rotary trommel screen 106, and the second product, the separation of the middle-sized material from the oversized material, has only the remaining, smaller, length of the rotary trommel screen 106, the distribution of resulting second and third products has been acceptably, and surprisingly, equal.

In some embodiments, the first screen section 122 has a uniform screen aperture size across the first screen section 122, regardless of the number of screen portions 120 that make up the first screen section 122. In other embodiments, the screen aperture sizes vary across the first screen section 122. In some embodiments, the first screen section 122 includes a first screen portion 120*a* that has oblong or rectangular apertures. Such oblong or rectangular apertures are greater in size than apertures of the remaining first screen section 122 screen portions 120*b*, 120*c* but less than the aperture size of the screen portions 120*d* of the second screen section 124. In some embodiments, the screen apertures of the first screen section 122 are about half the size of the screen apertures in the second screen section 124. In some embodiments, the screen apertures of the first screen section 122 are less than half the size of the screen apertures in the second screen section 124.

With continued reference to FIG. 1, the inlet conveyor 108 and outlet conveyor 110 are configured to introduce and remove material from the rotary trommel screen 106, respectively. In some embodiments, the inlet conveyor 108 can include an attached hopper 109 to aid in funneling material to the inlet conveyor 108. The outlet conveyor 110 is configured to move material that falls from the outlet 118 of the rotary trommel screen 106 to a discharge location away from the screening machine. Such material that is moved from the outlet 118 makes up a third product produced by the screening machine 100. In some embodiments, the third product is larger in size than the first and second products. In some embodiments, the outlet conveyor 110 is positioned transversely with respect to the rotary trommel screen 106. In other embodiments, the outlet conveyor 110 is positioned longitudinally with respect to the rotary trommel screen 106. In some embodiments, the screening machine 100 does not include an inlet or outlet conveyor 108, 110. In some embodiments, the inlet and outlet conveyors 108, 110 are belt conveyors.

The collecting conveyor 112 is configured to move the first product from the first collection area 126 away from underneath the rotary trommel screen 106. The movement of the conveyor 112 is represented by arrow C in FIG. 1 The collecting conveyor 112 is positioned underneath, and longitudinally, with respect to the rotary trommel screen 106. Further, the collection conveyer 112 is operated in a generally parallel manner with respect to the rotary trommel screen 106. In some embodiments, the collecting conveyor 112 is configured to move the first product in a direction toward the inlet of the rotary trommel screen 106. In some embodiments, the collecting conveyor 112 moves the first product to a hopper or external bin. In the depicted embodiment, the collecting conveyor 112 moves the first product to the front fines conveyor 113. In some embodiments, the collecting conveyer 112 is a belt conveyor.

The front fines conveyor 113 is configured to move the first product to a discharge location away from the screening machine 100. In some embodiments, the front fines conveyor 113 is positioned transversely with respect to the rotary trommel screen 106. In other embodiments, the front fines conveyor 113 is positioned longitudinally with respect to the rotary trommel screen 106. In some embodiments, the front fines conveyer 113 is a belt conveyor.

The rear fines conveyor 114 is configured to move the second product to a discharge location away from the screening machine 100. In some embodiments, the rear fines conveyor 114 is positioned transversely with respect to the rotary trommel screen 106. In other embodiments, the rear fines conveyor 114 is positioned longitudinally with respect to the rotary trommel screen 106. In some embodiments, the rear fines conveyer 114 is a belt conveyor.

In some embodiments, the front fines conveyor 113 is positioned in front of the wheels and axles 103 of the screening machine 100 (i.e. closer to the hitching end 105 of the trailer support 102), and the rear fines conveyor 114 is positioned behind the wheels and axles 103 of the trailer support 102. This positioning allows the screening machine 100 to retain adequate ground clearance while minimizing the height of the inlet conveyor 108 and inlet hopper 109.

Figure 2:
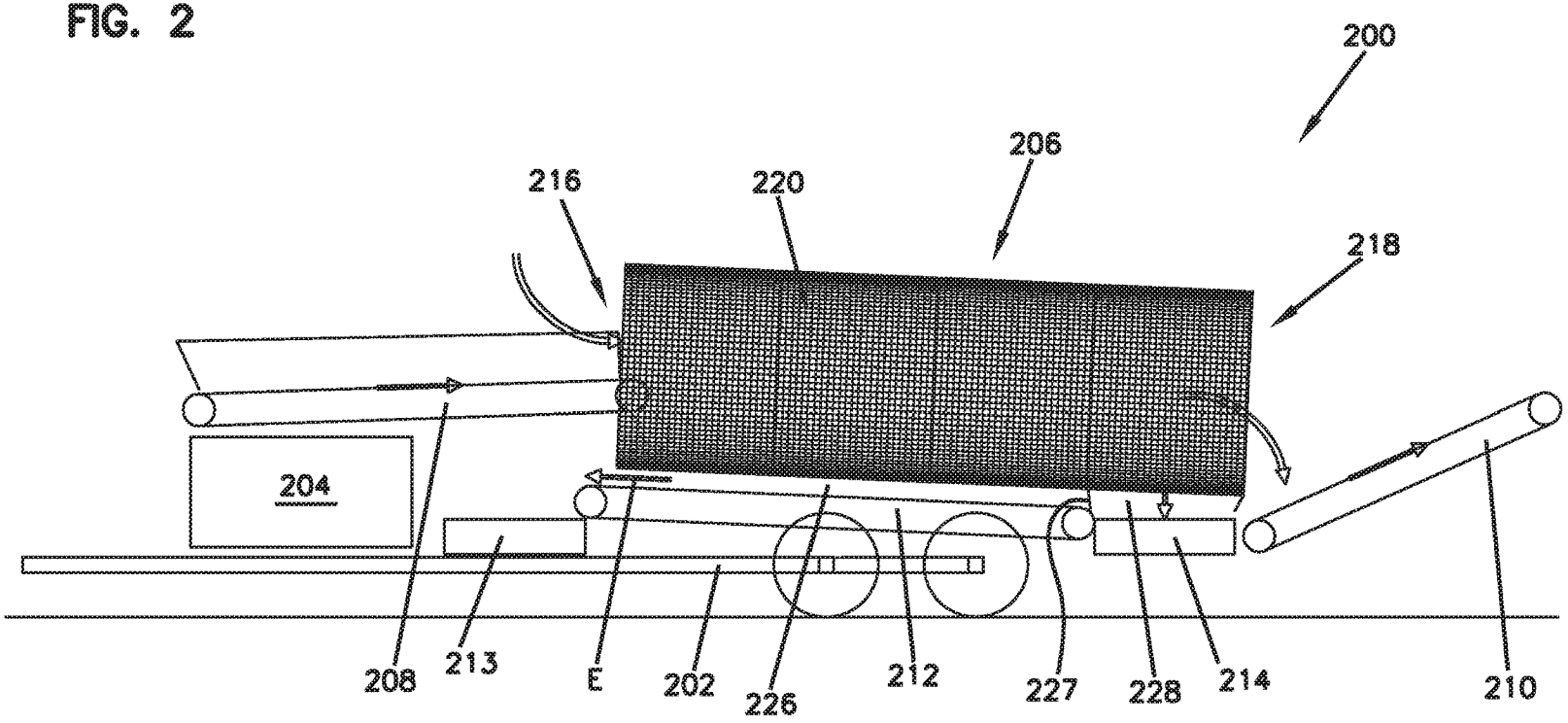
FIG. 2 illustrates a schematic side view of a screening machine configured to process three products, according to one embodiment of the present disclosure.
Figure 3:
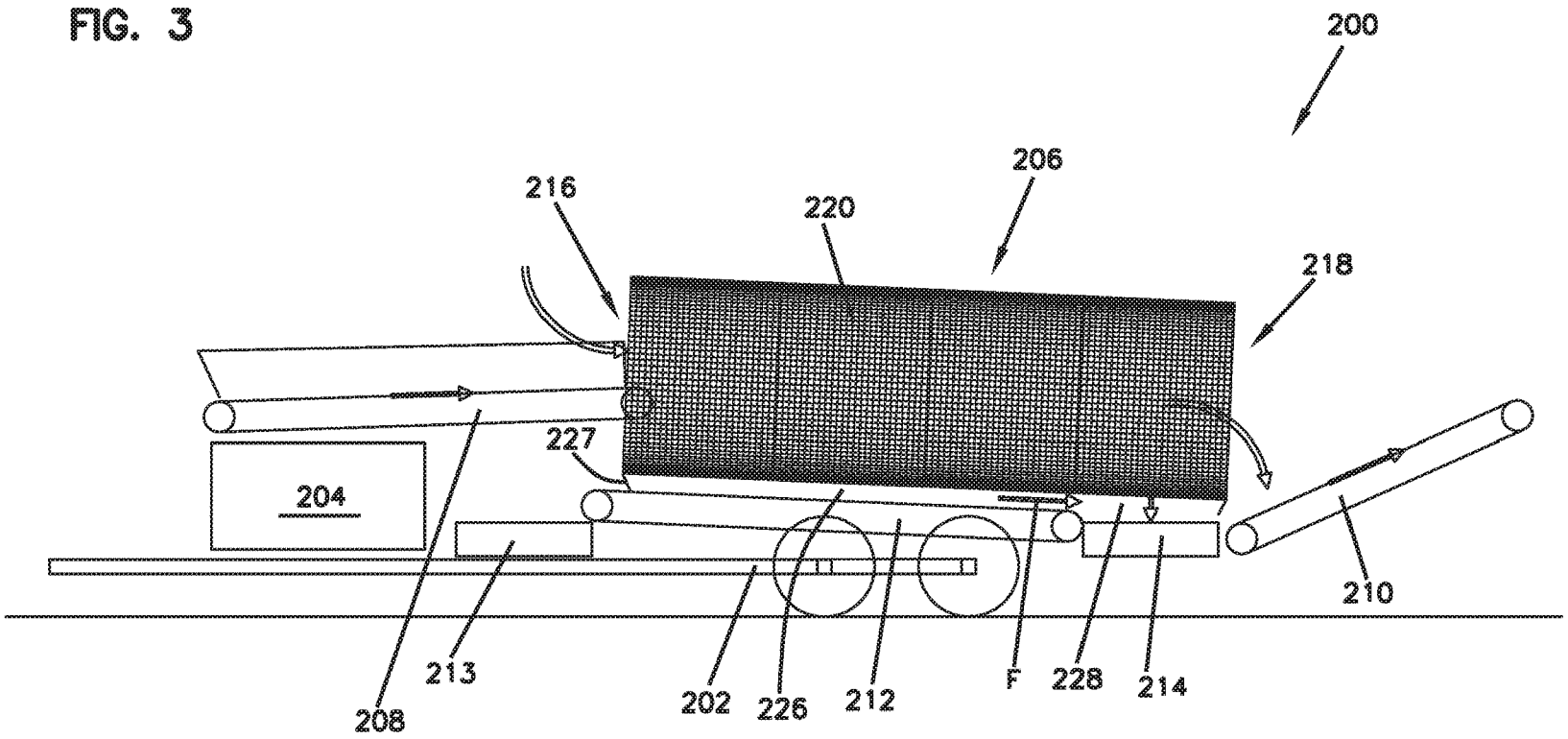
FIG. 3 illustrates a schematic side view of a screening machine configured to process two products, according to one embodiment of the present disclosure.

FIGS. 2 and 3 show a screening machine 200 in accordance with one embodiment of the present disclosure. Like the screening machine 100 described with respect to FIG. 1, the screening machine 200 includes a trailer support 202, a power system 204, a rotary trommel screen 206, an inlet conveyor 208, an outlet conveyor 210, a collecting conveyor 212, a front fines conveyor 213, and a rear fines conveyor 214. The screening machine 200 is configured to separate an unconsolidated material into two or three separate consolidated products, each separated product having a separate grade, by using a reversible collecting conveyor 212.

In the depicted embodiment, the trailer support 202, power system 204, inlet conveyor 208, outlet conveyor 210, front fines conveyor 213, and rear fines conveyor 214 operate in a substantially similar fashion to the corresponding like-named elements in the screening machine 100 of FIG. 1.

In some embodiments, the rotary trommel screen 206 can be substantially similar to the rotary trommel screen 106 as shown in FIG. 1. In the depicted embodiment, the rotary trommel screen 206 includes a plurality of screen portions 220 with generally uniform screen apertures along the overall length of the rotary trommel screen 206. However, it is contemplated that the rotary trommel screen 206 can have a plurality of screening portions 220 with a variety of different screen apertures sizes.

The collecting conveyor 212 is configured to be reversible and is movable in a direction toward a trommel inlet 216 (as shown in FIG. 2) or in a direction toward a trommel outlet 218 (as shown in FIG. 3). In some embodiments, the collecting conveyor 212 is attached to a control system that allows the user of the screening machine 200 to selectively reverse the collecting conveyor 212. In some embodiments, the collecting conveyor 212 is a belt conveyor.

In FIG. 2 the collecting conveyor 212 is shown moving in a direction toward the inlet 216 of the rotary trommel screen 206, represented by arrow E. In the depicted embodiment, the screening machine 200 is configured to separate three products from the material that is inserted at the inlet 216 of the rotary trommel screen 206. In some embodiments, removable guides 227 are placed at the end of the collecting conveyor opposite of the direction of travel of the collecting conveyor 212. The removable guides 227 are configured to aid in the separation of a first product in a first collection area 226, and a second product in a second collection area 228.

In FIG. 3 the collecting conveyor 212 is shown moving in a direction toward the outlet 218 of the rotary trommel screen 206, represented by arrow F. In the depicted embodiment, the screening machine 200 is configured to separate two products from the material that is inserted at the inlet 216 of the rotary trommel screen 206. Like in FIG. 2, removable guides 227 are placed at the end of the collecting conveyor 212 opposite of the direction of travel of the collecting conveyor 212. The removable guides 227 are configured help contain any product in the first collection area 226. When moving in a direction toward the outlet 218 of the rotary trommel screen 206, the collecting conveyor 212 takes product filtered by the rotary trommel screen 206 along the length of collecting conveyor 212 and moves the product to the second collection area 228, thereby creating a first product at the second collection area 228. In some embodiments, the first product that is collected in the second collection area 228 is moved away from the screening machine by way of the rear fines conveyor 214. In the depicted embodiment, the second product, which is larger in size than the first product, is removed from the outlet 218 of the rotary trommel screen 206. In some embodiments, the second product is moved away from the screening machine 200 by the outlet conveyor 210.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A screening machine comprising:

a rotary trommel screen having an overall length and an interior volume defined by a plurality of screen sections, the rotary trommel screen further having an inlet end and an outlet end, the interior volume of the rotary trommel screen being substantially unobstructed between the inlet end and the outlet end, the rotary trommel screen defining at least a first screen section and a second screen section, the first screen section being configured to yield a first product, the second screen section being configured to yield a second product;

a first collection area proximate to the inlet end and under the rotary trommel screen, wherein the first collection area corresponds to at least 65 percent of the overall length of the rotary trommel screen;

a second collection area proximate to the outlet end and under the rotary trommel screen, wherein the second collection area corresponds to the remainder of the overall length of the rotary trommel screen not corresponding to the first collection area, and wherein the first and second collection areas are configured to collect a first and second product respectively, the first screen section and the second screen section corresponding to the first and second collection areas, the first screen section and the second screen section being configured such that a size of the first product is different than the size of the second product; and a control system configured to control the screening machine in a first and a second mode, wherein, when in the first mode, the first product is collected at the first collection area, and when in the second mode, the first product is moved by the screening machine to the second collection area.

2. The screening machine of claim 1, wherein the first screen section is configured to deposit the first product in the first collection area, and wherein the second screen section is configured to deposit the second product in the second collection area.

3. The screening machine of claim 2, wherein the size of the first product is smaller than the size of the second product.

4. The screening machine of claim 2, wherein the first and second screen sections each have a plurality of screen apertures, the first screen section apertures having dimensions different than the second screen section apertures.

5. The screening machine of claim 4, wherein the first screen section apertures are smaller than the second screen section apertures.

6. The screening machine of claim 1, further comprising a first conveyor positioned to transport material collected by the first collection area, the first conveyer being configured to move material to a first discharge corresponding to the first collection area.

7. The screening machine of claim 6, further comprising a second conveyor positioned to transport material collected by the second collection area, the second conveyer being configured to move material to a second discharge corresponding to the second collection area.

8. The screening machine of claim 7, wherein the second conveyer is aligned transversely with the rotary trommel screen and configured to deposit material at a side of the rotary trommel screen.

9. The screening machine of claim 7, wherein the first conveyor is aligned longitudinally with the rotary trommel screen, and wherein the first conveyor is configured to move in a direction toward the inlet end of the rotary trommel screen.

10. The screening machine of claim 8, wherein the first conveyor is selectively reversible and configured to move in a direction toward the inlet end of the rotary trommel screen or in a direction toward the outlet end of the rotary trommel screen, wherein the first conveyor includes a first end and a second end, wherein the first end and the second end are unobstructed to allow material to flow in a longitudinal direction from either the first end or the second end.

11. The screening machine of claim 10, wherein the second conveyer is configured to receive material from the first conveyor.

12. The screening machine of claim 10, wherein the first conveyor moves material to a third conveyor when moving in a direction toward the inlet end of the trommel screen, the third conveyer being configured to move material to the first discharge corresponding to the first collection area.

13. The screening machine of claim 1, further comprising an outlet conveyor positioned at the outlet end of the rotary trommel screen.

14. The screening machine of claim 1, wherein the first collection area section is at least 70 percent of the overall length of the rotary trommel screen, and wherein the second collection area makes up the remainder of the overall length of the rotary trommel screen not occupied by the first collection area.

15. The screening machine of claim 1, further comprising:

a first discharge corresponding to the first collection area; and a second discharge corresponding to the second collection area.

16. The screening machine of claim 1, wherein a third product is separated and expelled from the outlet end of the rotary trommel screen.

17. A screening machine comprising:

a rotary trommel screen having an overall length, the rotary trommel screen further having an inlet end and an outlet end, the rotary trommel screen defining at least a first screen section and a second screen section, the first screen section being configured to yield a first product, the second screen section being configured to yield a second product;

a first collection area proximate to the inlet end and under the rotary trommel screen; and a second collection area proximate to the outlet end and under the rotary trommel screen, wherein the first and second collection areas are configured to collect a first and second product respectively, the first screen section and the second screen section corresponding to the first and second collection areas, the first screen section and the second screen section being configured such that a size of the first product is different than the size of the second product; and a first conveyor positioned longitudinally within the rotary trommel screen, wherein the first conveyor is selectively reversible and configured to move in a direction toward the inlet end of the rotary trommel screen or in a direction toward the outlet end of the rotary trommel screen, wherein the first conveyor includes a first end and a second end, wherein the first end and the second end are unobstructed to allow material to flow in a longitudinal direction along the first conveyor from either the first end or the second end, a second conveyor positioned to transport material collected by the second collection area, the second conveyer being configured to move material to a second discharge corresponding to the second collection area, wherein the first conveyor is positioned to transport material collected by the first collection area, the first conveyer being configured to move material to a first discharge corresponding to the first collection area;

wherein the screening machine is configured so that the first product can be selectively collected at the first collection area or moved to the second collection area via the first conveyor, wherein, when moving in a direction toward the outlet end of the rotary trommel screen, the first conveyor moves material to the second conveyor.

18. The screening machine of claim 17, wherein the second conveyer is aligned transversely with the rotary trommel screen and configured to deposit material at a side of the rotary trommel screen.

19. The screening machine of claim 17, wherein, when moving in a direction toward the inlet end of the rotary trommel screen, the first conveyor moves material to a third conveyor, the third conveyer being aligned transversely with the rotary trommel screen and configured to move material to the first discharge corresponding to the first collection area.

20. The screening machine of claim 17, wherein the first screen section is configured to deposit the first product in the first collection area; and wherein the second screen section is configured to deposit the second product in the second collection area.

21. The screening machine of claim 20, wherein the first and second screen sections each have a plurality of screen apertures, the first screen section apertures having dimensions different than the second screen section apertures.

22. The screening machine of claim 20, wherein the size of the first product is smaller than the size of the second product.

23. The screening machine of claim 17, further comprising an outlet conveyor positioned at the outlet end of the rotary trommel screen.

24. The screening machine of claim 17, wherein a third product is separated and expelled from the outlet of the rotary trommel screen.

25. A screening machine comprising:

a rotary trommel screen having an overall length and an interior volume, the rotary trommel screen further having an inlet end, an outlet end, and a plurality of sections, the interior volume of the rotary trommel screen being substantially unobstructed between the inlet end and the outlet end;

a trailer support frame supporting the rotary trommel screen, the trailer support frame including a plurality of wheels and axles and a hitching end, wherein the hitching end is configured to be attached to a towing vehicle for transport on public roadways;

a power system mounted to the trailer support frame, the power system being connected to the rotary trommel screen for rotating the rotary trommel screen;

a hopper mounted to the trailer support frame, the hopper being adjacent the inlet end of the rotary trommel screen so as to deliver material to the inlet end of the rotary trommel screen;

a first collection area proximate to the inlet end and under the rotary trommel screen, wherein the first collection area corresponds to at least 65 percent of the overall length of the rotary trommel screen;

a first conveyor positioned longitudinally within the rotary trommel screen and configured to transport material collected by the first collection area, the first conveyer being configured to move material to a first discharge corresponding to the first collection area;

a second collection area proximate to the outlet end and under the rotary trommel screen, wherein the second collection area corresponds to the remainder of the overall length of the rotary trommel screen not corresponding to the first collection area;

a second conveyor positioned to transport material collected by the second collection area, the second conveyer being configured to move material to a second discharge corresponding to the second collection area, and wherein the first and second collection areas are configured to collect a first and second product respectively, and wherein sections of the rotary trommel screen corresponding to the first and second collection areas are configured such that a size of the first product is different than the size of a second product.

26. The screening machine of claim 17, wherein the rotary trommel screen has an interior volume defined by the plurality of screen sections, the interior volume of the rotary trommel screen being substantially unobstructed between the inlet end and the outlet end.

27. The screening machine of claim 25, wherein the first conveyor is selectively reversible and configured to move in a direction toward the inlet end of the rotary trommel screen or in a direction toward the outlet end of the rotary trommel screen, wherein the first conveyor includes a first end and a second end, wherein the first end and the second end are unobstructed to allow material to flow in a longitudinal direction from either the first end or the second end.

28. The screening machine of claim 25, further comprising a control system, wherein the control system is configured to control the screening machine in a first and a second mode, and wherein, when in the first mode, the first product is collected at the first collection area, and when in the second mode, the first product is moved by the first conveyor to the second collection area.

* * * * *